US006764150B2

(12) United States Patent
Le et al.

(10) Patent No.: US 6,764,150 B2
(45) Date of Patent: Jul. 20, 2004

(54) JACKET FOR USE WITH A LOCK LATCH, A LOCK LATCH INCORPORATING THE SAME AND A SLIDE INCORPORATING THE LOCK LATCH AND JACKET

(75) Inventors: Baoloc Le, La Puente, CA (US); Charles A. Milligan, Hacienda Heights, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 10/222,018

(22) Filed: Aug. 15, 2002

(65) Prior Publication Data

US 2003/0042831 A1 Mar. 6, 2003

Related U.S. Application Data

(60) Provisional application No. 60/313,275, filed on Aug. 17, 2001.

(51) Int. Cl.[7] ..... A47B 88/00

(52) U.S. Cl. ..... 312/334.46; 312/334.44

(58) Field of Search ..... 312/334.44, 334.46, 312/334.8, 334.9

(56) References Cited

U.S. PATENT DOCUMENTS 5,466,060 A * 11/1995 Hoffman ..... 312/334.8
5,722,750 A 3/1998 Chu
5,951,132 A * 9/1999 Cirocco ..... 312/334.46
6,126,255 A * 10/2000 Yang ..... 312/334.46
6,244,678 B1 * 6/2001 Dopp et al. ..... 312/333
6,402,275 B1 * 6/2002 Yang ..... 312/334.46
6,655,763 B2 * 12/2003 Judge et al. ..... 312/334.46

* cited by examiner

*Primary Examiner*—Lanna Mai
*Assistant Examiner*—John Fitzgerald
(74) *Attorney, Agent, or Firm*—Christie, Parker & Hale, LLP

(57) ABSTRACT

A jacket for a lock latch, a lock latch incorporating such a jacket that allows a second slide member of a slide to engage and couple a first slide member of the slide without requiring manual manipulation of the lock latch, and a slide incorporating the same are provided. The jacket is slidably coupled to the lock latch which is coupled to the second slide member and is slidably moveable between a first position and a second position along the lock latch. When the second slide member is retracted relative to the first slide member during coupling of the second slide member to the first slide member, the jacket moves to the first position preventing the lock latch from interlockingly coupling with the first slide member. When the second slide member is extended relative to the first slide member, the jacket moves to a second position allowing for the interlocking coupling of the lock latch with the first slide member.

20 Claims, 11 Drawing Sheets

200
206
204
8B
236
87
222
202
242
208
220
230
209
205
210
214

JACKET FOR USE WITH A LOCK LATCH, A LOCK LATCH INCORPORATING THE SAME AND A SLIDE INCORPORATING THE LOCK LATCH AND JACKET

CROSS REFERENCE TO RELATED APPLICATION

This application claims the benefit of and is based on Provisional Application Serial No. 60/313,275 filed on Aug. 17, 2001, the contents of which are fully incorporated herein by reference.

BACKGROUND OF THE INVENTION

The present invention relates to a lock latch for preventing the disengagement of one slide member from another. More specifically, the present invention is directed to a jacket for a lock latch, a lock latch incorporating such a jacket that allows one slide member to engage and couple to another slide member without requiring manual manipulation of the lock latch, and to a slide incorporating the same.

Slides which are used to slidably couple drawers to a cabinet or desk, consist of two or more members, a stationary member and at least one telescoping member. The stationary member is typically mounted in the cabinet or desk, while the telescoping member is connected to the drawer. Two slides are typically used to couple the drawer to the cabinet or desk, one on either side of the drawer.

A three member slide has an intermediate telescoping member slidably engaged by means of ball bearings fitted in bearing retainers with the stationary member and another telescoping member to enable longer drawer extensions. In a two member slide, the telescoping member is coupled to the stationary member by means of ball bearings fitted in a bearing retainer. The ball bearings ride on bearing raceways formed on each slide member.

To allow for the drawer to easily disconnect from the cabinet or desk, the telescoping members of the slide are made so that they can easily disconnect from the slide. Typically, it is the telescoping member connected to the drawer that is made to easily disconnect from the slide. A lock latch is typically mounted on the telescoping member. The latch engages an end of the slide member coupled to the telescoping member. To disconnect the telescoping member from the slide, i.e., to disconnect the drawer from the cabinet or desk, the latch on each slide telescoping member on either side of the drawer is pushed in while the drawer is pulled open, releasing the telescoping members from the remaining members of the slides. Similarly, to reconnect the telescoping member to the slide, the lock latch must be pushed in to allow the telescoping member to slide within the appropriate member of the slide. This makes reconnection of the telescopic member when mounting a drawer to a cabinet difficult. As such, a lock latch is desired that allows the telescoping member of a slide to be inserted into and coupled to the slide without requiring manual manipulation of the lock latch.

SUMMARY OF THE INVENTION

A jacket for a lock latch, a lock latch incorporating such a jacket that allows a second slide member of a slide to engage and couple a first slide member of the slide without requiring manual manipulation of the lock latch, and to a slide incorporating the same are provided. The jacket is slidably coupled to the lock latch coupled to the second slide member and is slidably moveable between a first position and a second position along the lock latch. When the second slide member is retracted relative to the first slide member during coupling of the second slide member to the first slide member, the jacket moves to the first position preventing the lock latch from interlockingly coupling with the first slide member. When the second slide member is extended relative to the first slide member, the jacket moves to a second position allowing for the interlocking coupling of the lock latch with the first slide member.

In one exemplary embodiment, the first slide member has at least one protrusion and the lock latch includes at least one cut out. With this exemplary embodiment, the lock latch interlockingly couples with the first slide member when at least one protrusion of the first slide member penetrates the at least one cut out of the lock latch. When in the first position, the jacket blocks the at least one cut out preventing penetration of the cut out by the at least one protrusion. The at least one protrusion engages the jacket to move it to the first position when the second slide member is retracted relative to the first slide member during coupling of the second slide member to the first slide member, and the at least one protrusion engages the jacket to move it to the second position when the second slide member is extended relative to the first slide member.

In another exemplary embodiment, the lock latch has a protrusion and the first slide member has a depression, as for example and opening. With this exemplary embodiment, when the jacket is in the second position the protrusion is allowed to penetrate the depression for interlockingly coupling the lock latch to the first slide member.

In an exemplary embodiment, the jacket has a first surface opposite a second surface sandwiching the lock latch. In another exemplary embodiment, the jacket is integrally formed as a unit.

DETAILED DESCRIPTION

The inventive jacket or lock latch with jacket can be incorporated in any multiple member slide as for example, a two member slide or a three member slide. With a two member slide, the lock latch with jacket will be incorporated in one of the two slides members. With a multiple member slide the lock latch with jacket will preferably be fitted in the slide member that needs to be disconnected from the slide. For descriptive purposes, the present invention is described in conjunction with a three member slide.

Figure 1A:
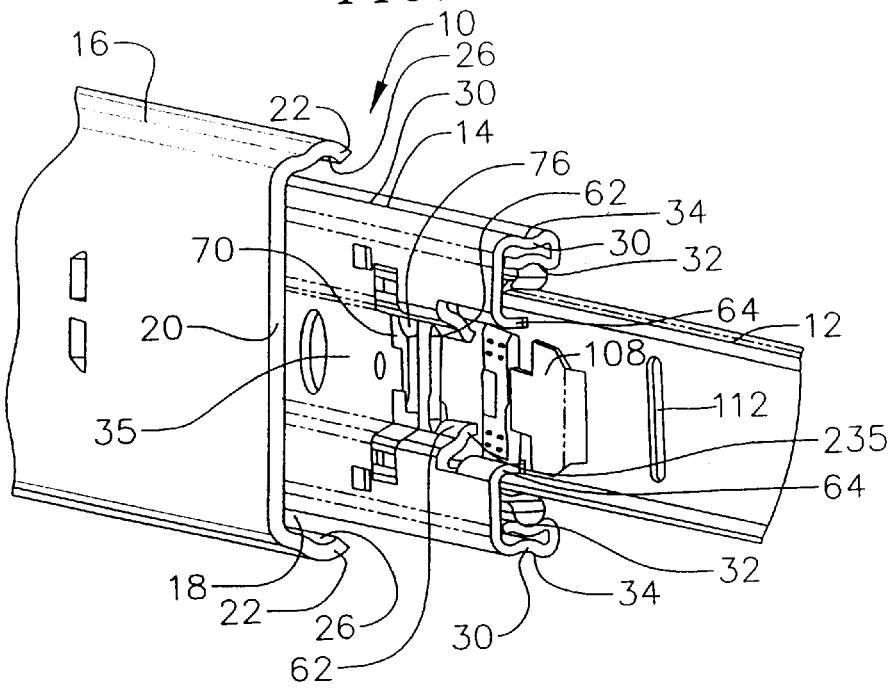
FIGS. 1A and 1B are perspective and top views, respectively of a slide incorporating an exemplary embodiment lock latch jacket of the present invention.
Figure 2:
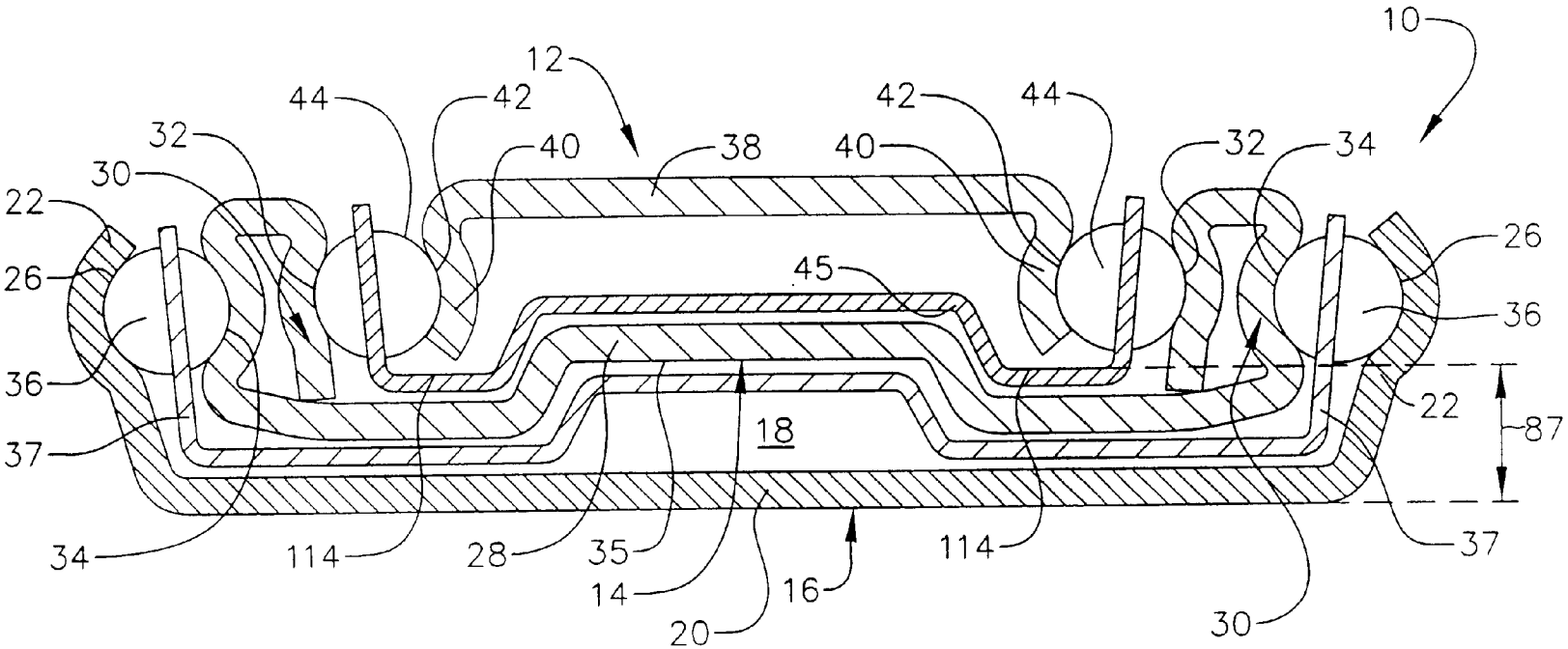
FIG. 2 is a cross-sectional view taken along arrows 2—2 of the slide shown in FIG. 1.

A typical three member slide 10 comprises an inner telescoping member 12 slidably coupled to an intermediate telescoping member 14 which is slidably coupled to an outer stationary member 16 (FIGS. 1A and 2). The outer member is channel shaped in cross section, i.e., it defines a channel 18, having web 20 and two legs 22 extending transversely from opposite ends of the web. An inner bearing raceway 26 is defined on each leg 22. The intermediate slide member 14, also generally channel shaped in cross-section, is slidably coupled within the outer member 16.

In cross-section, the intermediate member also comprises a web 28 and two legs 30 extending from opposite ends of the web. Each of the legs defines an inner raceway 32 and an outer raceway 34. A central portion of the intermediate member web 28 may define a longitudinal depression 35. The intermediate member is slidably coupled within the outer member with their "channels" facing in the same direction. Ball bearings 36 are sandwiched between the inner bearing raceways 26 of the outer member and the outer bearing raceways 34 of the intermediate member. The ball bearing are typically coupled to an outer ball bearing retainer 37.

The inner member is also channel shaped in cross-section comprising a web 38 having two legs 40 extending from opposite ends of the web. A concavity is formed on the outer surface of each leg defining an outer bearing raceway 42. The inner member is slidably coupled to the intermediate member with the channel of the inner member facing the channel of the intermediate member. In other words, the legs of the inner member extend from the web 38 of the inner member toward the web 28 of the intermediate member. Ball bearings 44 are sandwiched between the outer bearing raceways 42 of the inner member and the inner bearing raceways 32 of the intermediate member. The ball bearing are typically coupled to an inner ball bearing retainer 45. Each slide member is typically formed from a single piece of material.

Figure 1B:
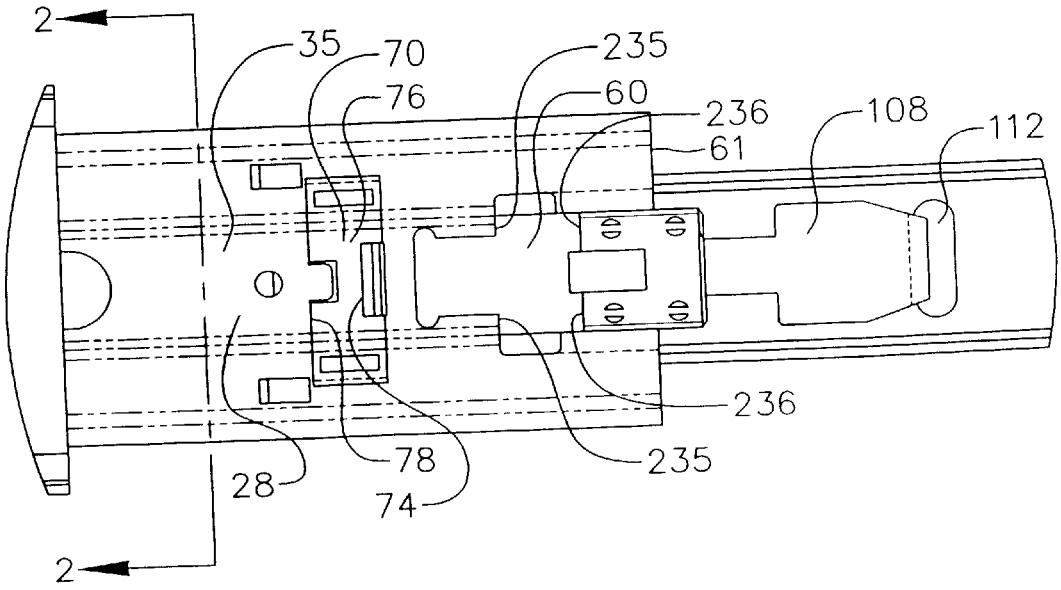
Figure 3B:
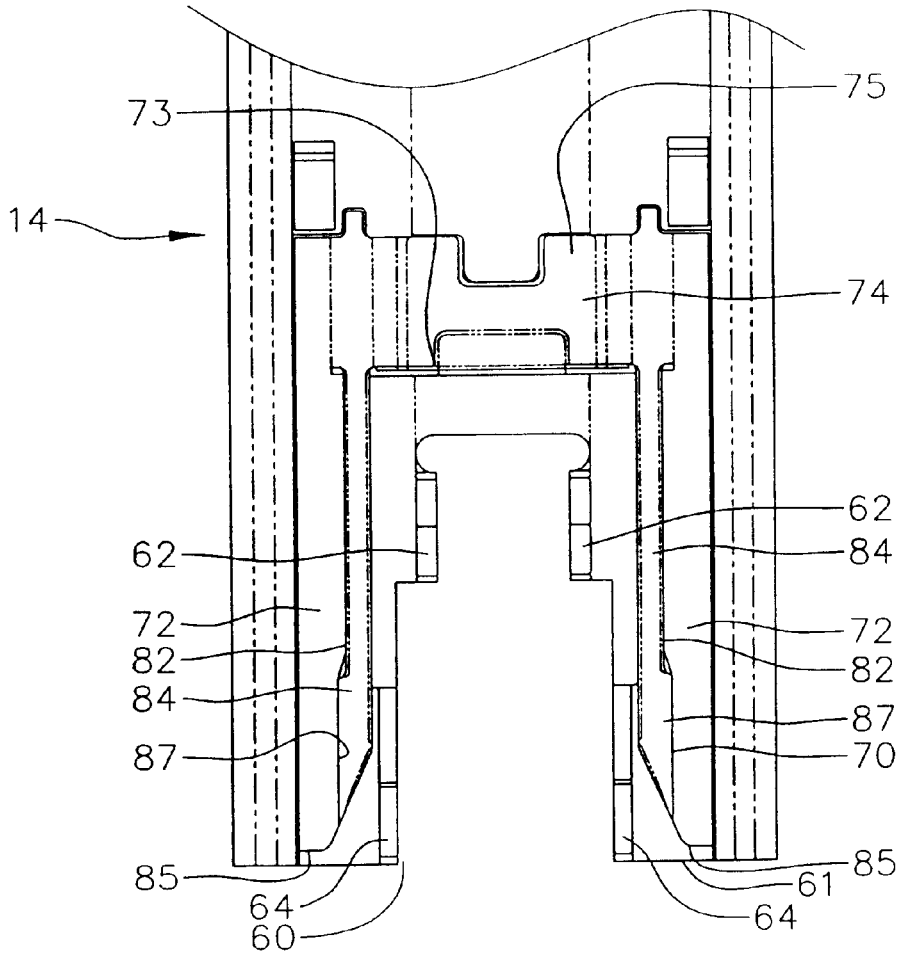
FIGS. 3A and 3B are an end view and a bottom view, respectively of the intermediate member of the slide shown in FIG. 1A.
Figure 3A:
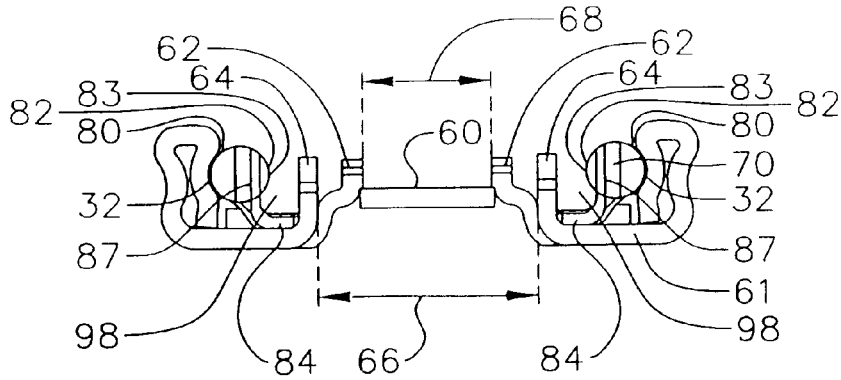
Figure 4A:
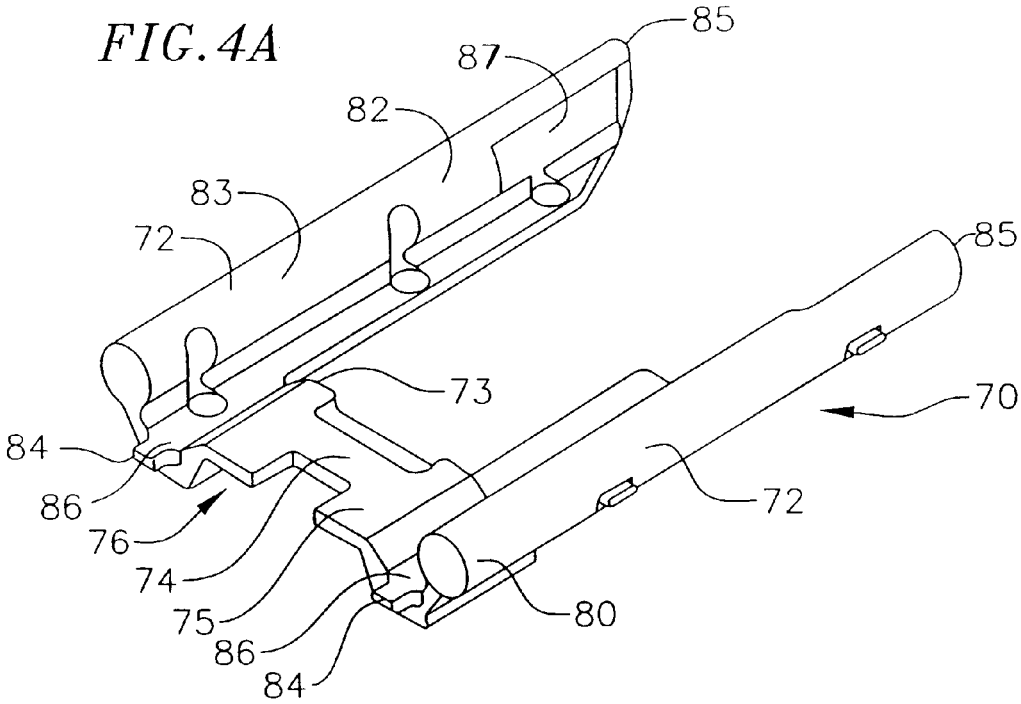
FIGS. 4A, 4B, 4C and 4D are perspective, top, end and side views, respectively of a guide block incorporated in the slide shown in FIG. 1A.
Figure 4B:
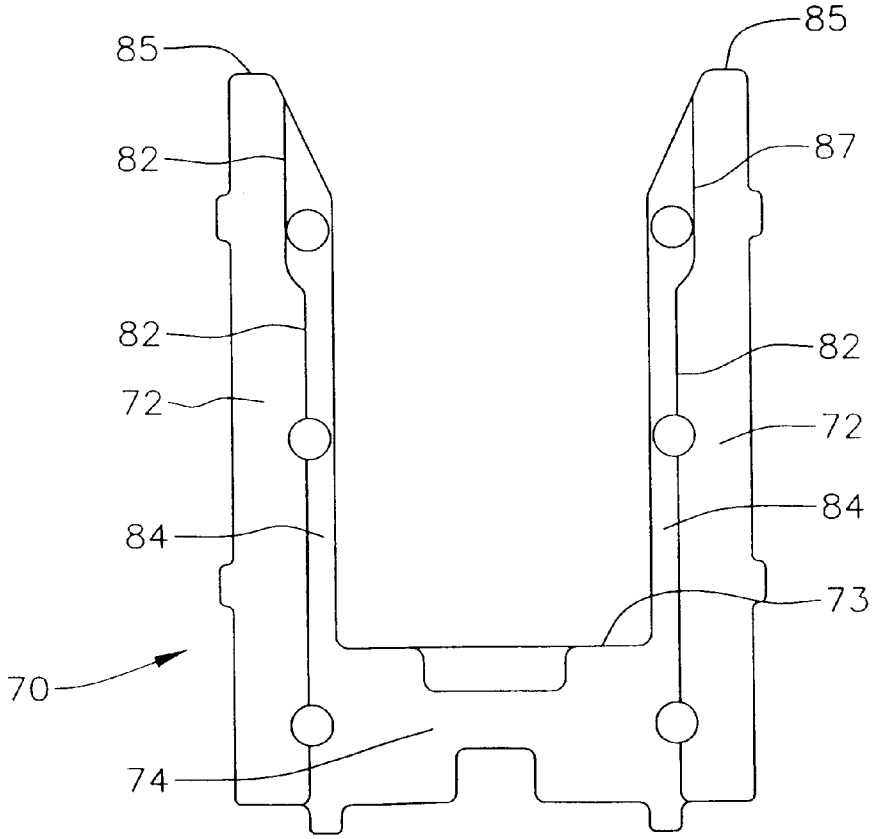
Figure 4C:
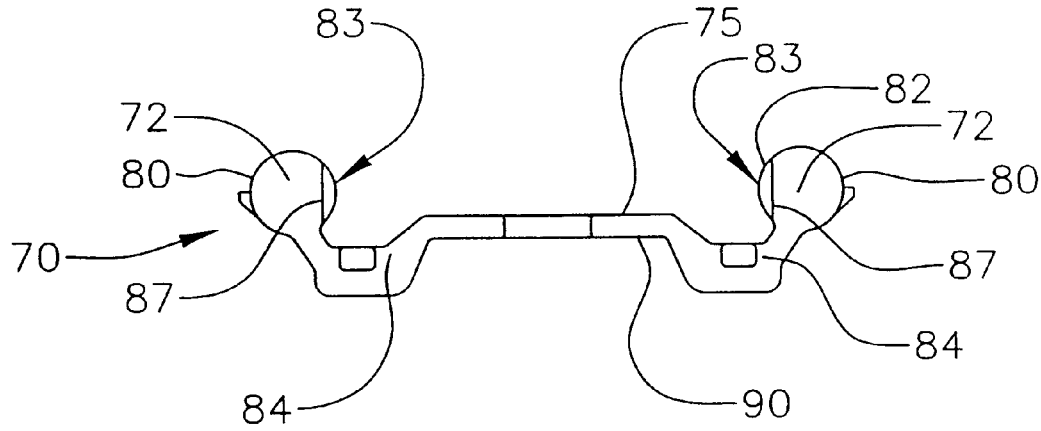
Figure 4D:
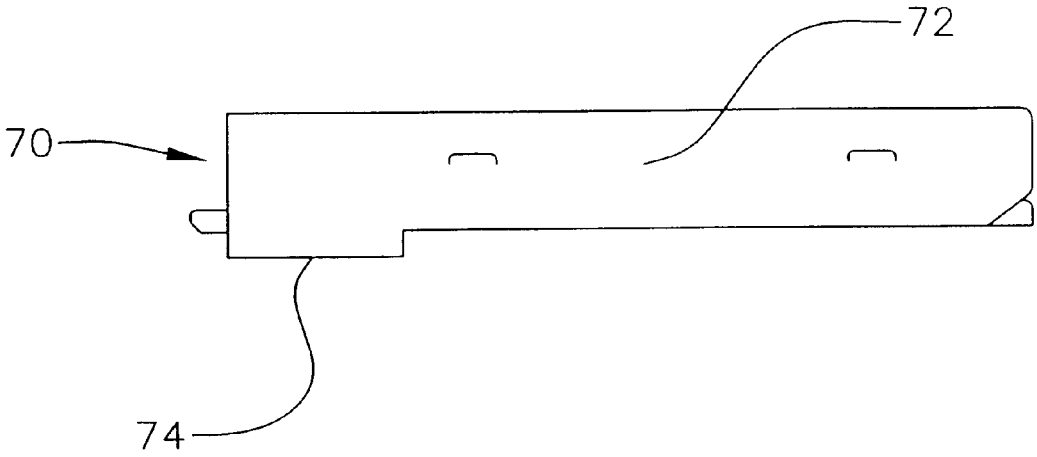

A guide block 70 as for example the guide block shown in FIGS. 4A, 4B, 4C and 4D, is inserted into the raceways of the intermediate member proximate the end 61 of the intermediate member from which the inner member extends, as for example shown in FIGS. 3A and 3B. The guide block comprises two spaced apart legs 72 and a web 74 formed there between such that each leg extends both longitudinally and laterally from the web 74. In an exemplary embodiment, the guide block web 74 is complementary in cross-section to the web 28 of the intermediate member and as such also defines a depression 76 complementary to the depression 35 defined on the web 28 of the intermediate slide member. An opening 78 if formed transversely across the web 28 of the intermediate member to accommodate the web 74 of the guide block (FIGS. 1A and 1B). As can be seen in FIG. 4D, the web 74 of the guide block extends below the legs 72 of the guide block. In this regard, the web 74 can be accommodated in opening 78 while the legs 72 can be accommodated within the channel of the intermediate member.

Each guide block leg outer surface comprises an outer portion 80 and an inner portion 83. The outer portion 80 of the outer surface of each leg 72 of the guide block is complementary to an inner bearing raceway 32 of the intermediate member. A first section 82 of the outer surface inner portion 83 of each leg opposite the outer portion 80 of each leg is complementary to the outer bearing raceway 42 of the inner member. In the exemplary embodiment shown in FIG. 3B, the complementary section 82 of the inner portion of the outer surface of each leg does not extend to the end 85 of the leg furthest from the guide block web 74. A relatively flat outer surface inner portion second section 87 extends from the first section 82 to the end of each leg 72. In an alternate exemplary embodiment, the first section of the outer surface inner portion may span the length of the guide block leg. A lip 84 extends inwardly from each leg 72 of the guide block. A surface 86 of each lip faces in the direction of the legs of the guide block and is generally parallel to a first surface 75 of the guide block web 74.

Figure 5:
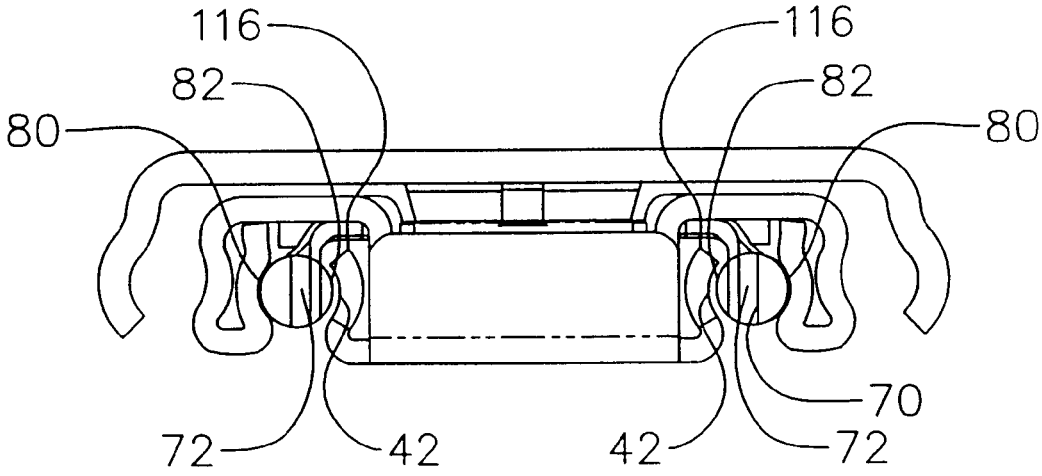
FIG. 5 is an end view of the slide shown in FIG. 1A.

The guide block is fitted in the end portion of the intermediate member, such that the outer surface portions 80 of the block legs are accommodated by the intermediate member inner bearing raceways while the block web is accommodated in the intermediate member web opening 78, as for example shown in FIGS. 3A, 3B and 5. When mounted on the intermediate member, the guide block lip portion surfaces 86 extend to a level above the web of the intermediate member that is equal or greater in height than the level 87 of the bearing retainer 45 sections 114 (FIG. 2). A slot 98 is defined between the inner portion second section 87 of the outer surface of each leg of the guide block and a second set lance tab 64. These slots serve to guide the legs of the inner member when the inner member is being reconnected to the intermediate slide member. An exemplary embodiment guide block is made from a plastic material, as foe example, ABS plastic or molded acetal.

A lock latch mechanism is formed on the intermediate and inner slides to allow the inner slide to disconnect and reconnect to the intermediate slide. An exemplary embodiment lock latch mechanism includes a cut out 60 and a lock latch 99. The cut out 60 is formed at and end portion of the web of the intermediate member web 28 and extends to the end 61 of the intermediate member from which the inner member extends. Two set of lance tabs are formed along the sides of the cut out. The first set of lance tabs comprises two tabs 62 located opposite each other and extend from opposite edges of the cut out toward the inner slide member. The second set comprises two lance tabs 64 located opposite each other extending from opposite edges of the cut out. The second set of lance tabs are located at the end of the cut out at the end 61 of the intermediate member and are spaced apart further than the first set of lance tabs, i.e., the spacing 66 between the two second set tabs 64 is greater than the spacing 68 between the two first set tabs 62. The first set of lance tabs is furthest from the end 61 of the intermediate member from which the inner member 14 extends than the second set of lance tabs.

Figure 7:
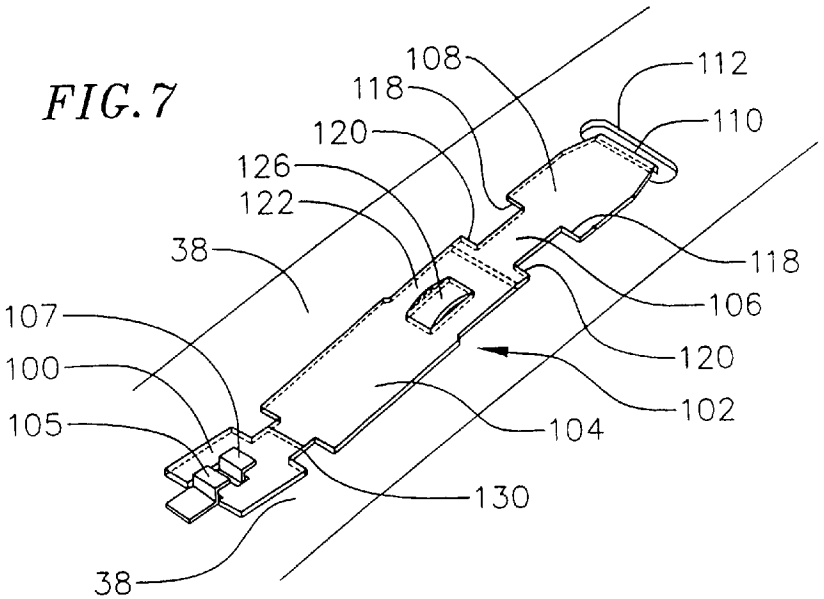
FIG. 7 is a perspective view of the lock latch shown in FIG. 6A attached to a slide member web.
Figure 6B:
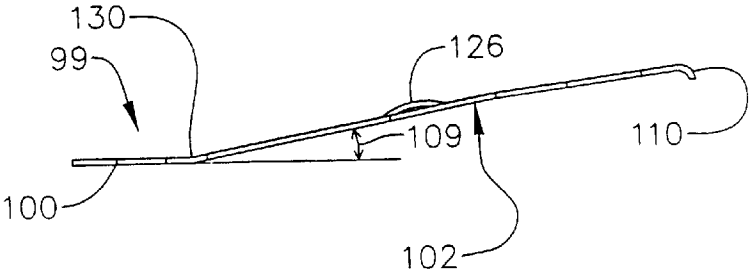
FIGS. 6A, 6B and 6C are top, side and end views, respectively of an exemplary embodiment lock latch of the present invention without incorporating a jacket.
Figure 6A:
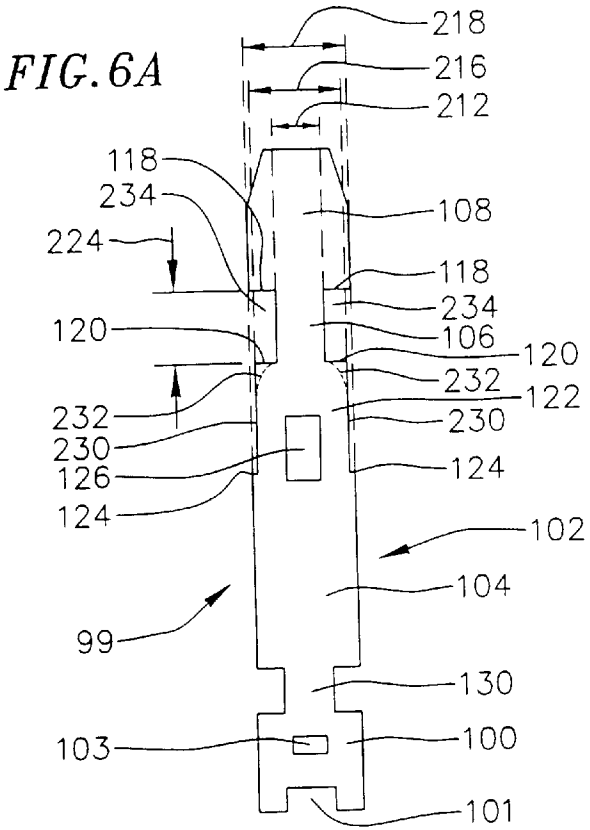
Figure 6C:
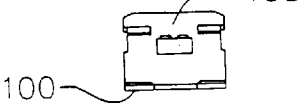

A spring tab forming the lock latch 99 is attached to the web 38 within the legs 40 of the inner member 12. An exemplary lock latch as shown in FIG. 6A has a first portion 100 which is attached to the inner member web 38 as shown in FIG. 7. In the exemplary embodiment, the first portion is formed with an end cut out 101 and a slot 103 for accommodating tabs for clamping the latch first portion to the inner member web. A first tab 105 cut from the inner member web 38 penetrates the end cut out 101 and is bent over the first portion clamping the first portion against the inner member web. A second tab 107 cut from the inner member web penetrates the slot 103 and is bent over the first portion clamping the first portion against the inner member web. Other methods, well known in the art may also be used to attach the first portion of the lock latch to the inner member web.

A second portion 102 of the inner member web from the inner member web. The second portion comprises a body portion 104 which narrows to a neck portion 106 which widens to a head portion 108. The neck portion is relatively centered along the width of the body and head portion defining cut outs 234 on either side thereof. The tip end 110 of the head portion is bent toward the web of the inner member and a slot 112 is formed through the inner member web to accommodate the bent tip portion when the lock latch is pushed again the inner member web (FIGS. 6B and 7). A narrower fourth portion 130 may interconnect the first and second portions as for example shown in FIGS. 6A, 6B and 7. In the exemplary embodiment, the second portion is angled so that the second portion extends relative to the first portion at the angle 109. In the exemplary embodiment, the entire lock latch is integrally formed from a single sheet of material which provides the lock latch with spring like characteristics such that when the second portion is pushed toward the inner member web, the second member will spring back to its original bent position relative to the first portion, once the force pushing it is removed.

In the exemplary embodiment, an end section 122 of the body portion 104 of the lock latch adjacent to the neck portion 106 is narrowed such that its width 216 smaller is than the width 218 of the remaining body portion and head portion but greater than the width 212 of the neck portion 106. Consequently, shoulders 124 are formed on the body portion adjacent the end section 122. Furthermore, in the exemplary embodiment, a central portion 126 of the end section 122 is raised relative to the end section.

Figures 8A, 8B, 8C, 8D, 8E:
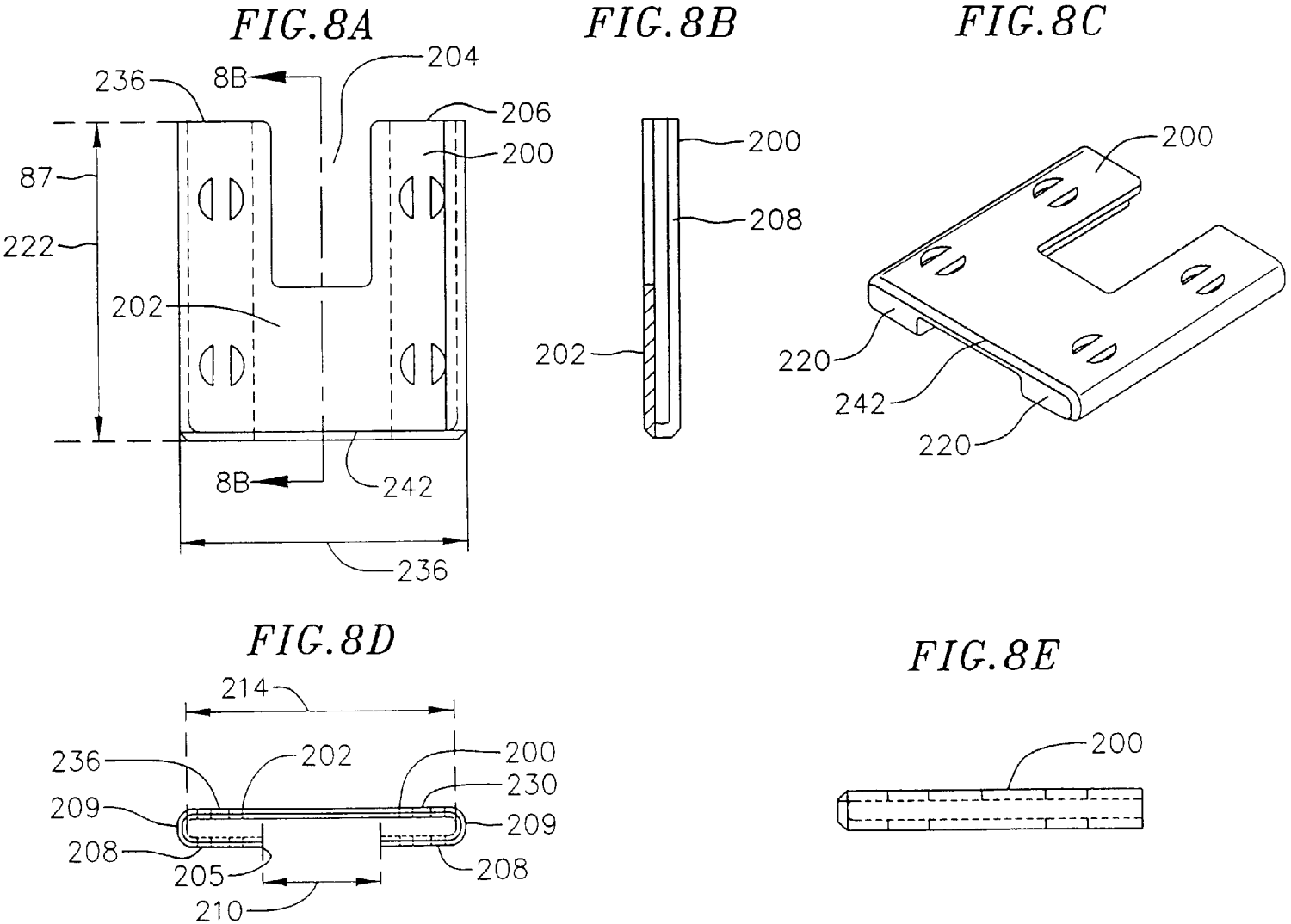
FIGS. 8A, 8B, 8C, 8D and 8E are top, cross-sectional, perspective, end, and side views, respectively of an exemplary embodiment lock latch jacket of the present invention.
Figure 9:
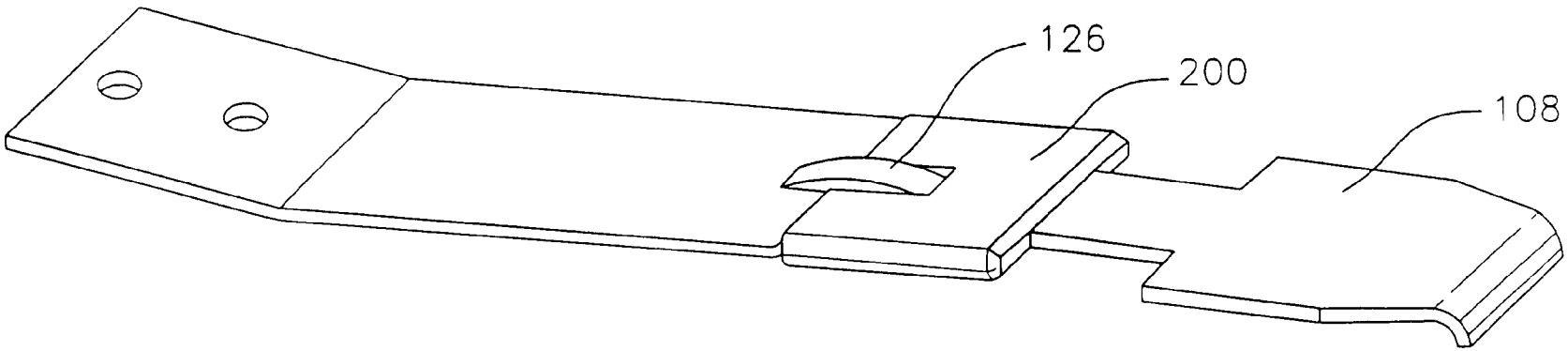
FIG. 9 is a perspective view of a guide tab of an exemplary embodiment lock latch of the present invention incorporated an exemplary embodiment jacket of the present invention.
Figure 10A:
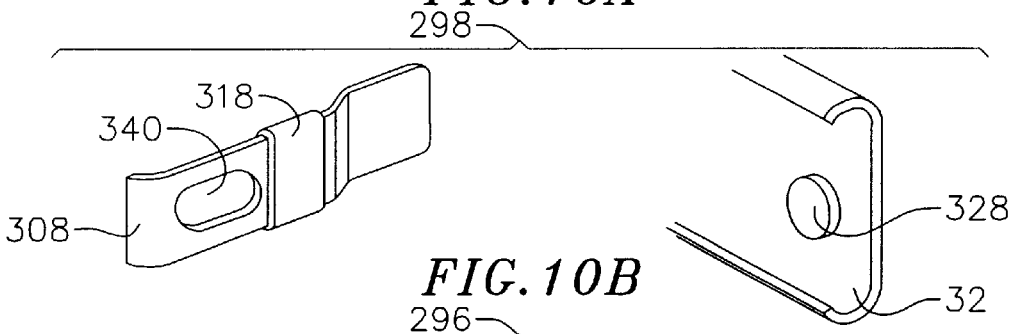
FIGS. 10A, 10B, 10C, 10D, and 10E depicts five different lock latch/slide arrangements, respectively forming five different lock latch mechanisms incorporating lock latch jackets of the present invention.
Figure 10B:
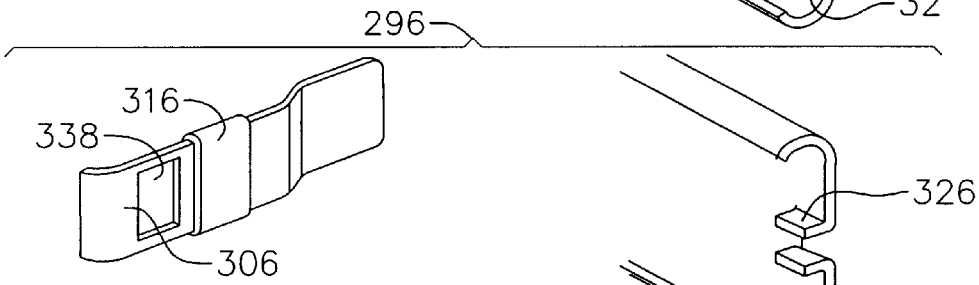
Figure 10C:
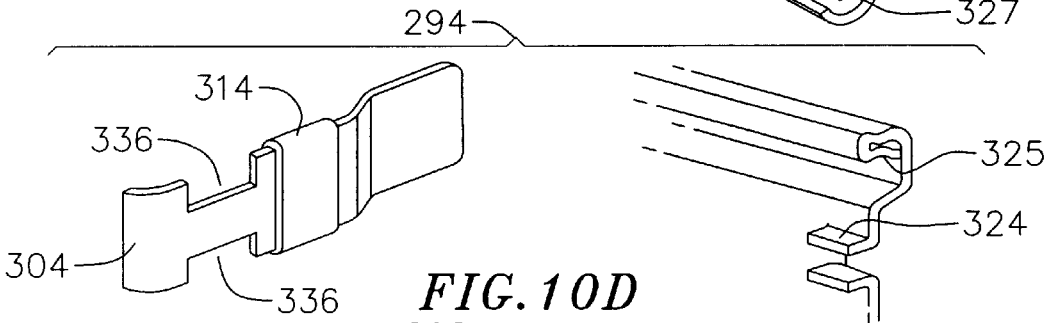
Figure 10D:
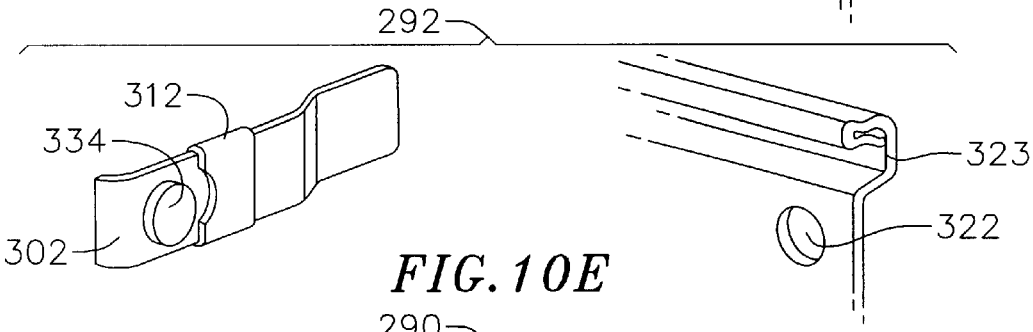
Figure 10E:
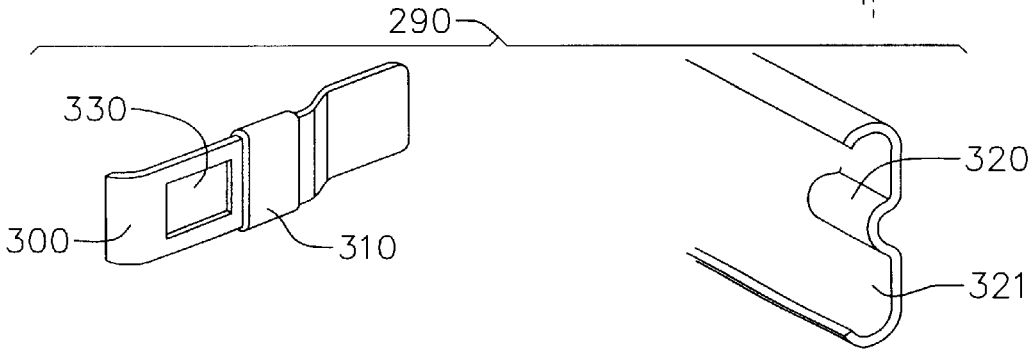

A jacket 200 (FIGS. 8A, 8B, 8C, 8D and 8E) is fitted in sliding surrounding relationship to the neck portion 106 of the lock latch as for example shown in FIG. 9. In the exemplary embodiment, the jacket 200 comprises a first panel 202 having a cut out 204 extending to an end 206 of the first panel. Opposite side ends of the first panel are folded defining two second panels 208 spaced apart from each other and opposite the first panel 202 and defining two opposite sides 209. In the exemplary embodiment, the spacing 210 (FIG. 8D) between the two second panel ends 205 is smaller than the width 212 of the lock latch neck portion 106 and smaller than the width 216 of the end section 122 of the body portion of the lock latch (FIG. 6A). Furthermore, the distance 214 (FIG. 8D) between the inner surface of the two sides 209 is greater than the width 216 of the end section 122 of the body portion of the lock latch and smaller than the width 218 of the body portion 104 and head portion 108 of the lock latch (FIG. 6A). An end web 220 is defined between each second panel and the first panel of the jacket as for example shown in FIG. 8C. The length 222 of the jacket is at least as great as the length 224 of the neck portion 106 of the lock latch.

The jacket is preferably made from a flexible material as for example, a plastic material. In the exemplary embodiment shown in FIG. 8A, the jacket is injection molded form a plastic material. Due to its flexibility, the jacket can be easily slipped over the neck portion 106 of the lock latch and slid over the end section of the body portion of the lock latch. By slightly flexing the jacket about a longitudinal axis, the distance 210 between the ends 205 of the second panels can be increased to be greater than the width 212 of the neck portion of the lock latch. In this regard, the neck portion can fit between the spacing 210 defined between ends of the second panel. The jacket is then pushed such that side edges 230 of the end section 122 of the body portion of the lock latch slide between the second panels and the first panel of the jacket. To facilitate the sliding, the corners of the end section of the body portion approximate the neck portion maybe rounded, as for example shown by dash lines 232 in FIG. 6A.

Once installed, the jacket can slide over the end section of the body portion until the end 206 of the jacket strikes the shoulders 124 defined on the body portion. When that occurs, the jacket cut out 204 accommodates the raised portion 126 of the lock latch end section. The raised central portion may also serve to limit the slidable movement of the jacket relative to the lock latch. When mounted on the lock latch, the jacket can move from a position occupying the length 126 of the cut outs 234 defining the neck portion, to a position over the end section of the body portion exposing the cut outs 234 defining the neck portion. The width 236 of the jacket as shown in FIG. 8A should be smaller than the distance 66 between the second set lance tabs 64 and greater than the distance 68 between the first set lance tabs 62.

To connect the inner member to the intermediate member, the leg portions of the inner member are slid within the slots 98 defined between the outer surface inner portion second sections of the guide block and the second set lance tabs 64 (FIG. 3A). As the legs of the inner member are pushed further toward the intermediate member, the inner member outer bearing raceways 42 move over the guide block outer surfaces coupling the inner member to the intermediate member. As the inner member is further slid over the intermediate member, the edges 116 of the legs of the inner member move over their corresponding guide block lip surfaces 86. As the inner member is further moved in the direction toward the intermediate member, the member legs continue to slide along the guide block legs inner surface and lip portions and are guided by the lip to retainer 45. Because the lip portions of the guide block legs extend to a level as high or higher than that of the retainer section 114 in relation to the intermediate member web, the guide block lip portions prevent the legs of the inner member from striking the end edges of the bearing retainer 45. As the inner member is further slid toward the intermediate member, it moves the jacket within the space defined between the second set lance tabs 64 (FIG. 1A). As the inner member is further slid toward the intermediate member, the ends 235 of the first set lance tabs 62 strike the edges 236 of the second panels of the jacket, causing the jacket to slide over the neck portion 106 so as to cover the cut outs 234 defining the neck portion. As the inner slide member is moved further toward the intermediate member, the first set lance tabs 62 continue to apply a force against the edges 236 of the jacket while the edges 118 of the head portion adjacent to the neck of the lock latch, prevent movement of the jacket. When this occurs, the force applied by the first set lance tabs, causes the latch to move toward the inner member web, i.e., to flex generating a spring force and allowing the inner member and lock latch to move past the first set lance tabs and the lance tabs to ride on the jacket and head portions of the lock latch. When this occurs, the jacket prevents the first set lance tabs from penetrating the cut outs 234 defining the neck portion of the lock latch and thus, prevents the first set lance tabs from engaging the edges 118 of the lock latch head portion.

Consequently, the lock latch does not have to be manipulated for allowing complete re-connection of the inner member with the intermittent member. When the inner member is slid within the intermediate member, the web of the intermediate member pushes the lock latch toward the inner member web member generating a force tending to urge the lock latch toward the intermediate member web. Furthermore, the raised portion 126 of the lock latch rides against the ball retainer 45 when the inner member is connected to the intermediate member, spacing the jacket from the ball retainer 45. In this regard, the jacket does not contact the intermediate member or the ball retainer, consequently, preventing wear on the jacket when the inner member slides relative to the outer member.

When extending, the inner slide member relative to the intermediate member, the first set lance tabs 62 engage the edge 242 of the jacket first panel opposite the edges 236 causing the jacket to slide over the lock latch body portion end section until movement of the jacket stops against the shoulders 124. When that occurs, the cut outs 234 defining the neck portion are exposed. The spring force generated by the flexed lock latch causes the latch to spring away from the inner member web causing the first set lance tabs to penetrate the cut outs and straddle the neck portion 106 of the lock latch thereby, preventing the disengagement of the inner member from the intermediate member. To further disengage the inner member from the intermediate member, the lock latch has to be pushed toward the inner member web thereby unstraddling the neck portion of the lock latch and allowing the lock latch and inner member to move past the first set lance tabs.

The jacket of the present invention can be made to be used with various different types of lock latches which are used as part of different lock latch mechanisms as for example mechanisms 290, 292, 294, 296, and 298 shown in FIGS. 10A, 10B, 10C, 10D, and 10E, respectively. For example, a jacket can be incorporated into lock latches 300, 302, 304, 306 and 308 shown in FIGS. 10A, 10B, 10C, 10D, and 10E, respectively for preventing engagement of such lock latches with another slide member forming the lock latch mechanism when the slide incorporating the lock latch is reconnected to such slide member. For example, lock latches jackets 310, 312, 314, 316 and 318 can be used with latches 300, 302, 304, 306 and 308 respectively for preventing the lock latches from engaging various protrusions or openings in a slide member forming the lock latch mechanism in combination with these lock latches. For example, jacket 310 can move into position blocking opening 330 formed on lock latch 300 and thereby preventing the opening from being engaged by the protrusion 320 formed on slide member 321 when a slide incorporating the lock latch is being reconnected to slide member 321 having the protrusion 320. Similarly, jacket 312 can move into position surrounding protrusion 334 of lock latch 302 so as to prevent protrusion 334 from penetrating opening 322 in the slide member 323. For example, jacket 314 can move over cut outs 336 of the lock latch 304 for preventing the lance tabs 324 of slide member 325 from penetrating such cut outs. Similarly, jacket 316 can move into position covering opening 338 formed on the lock latch 306 for preventing lance tabs 326 of the slide member 327 from penetrating the opening 338. Furthermore, jacket 318, can move into position blocking opening 340 formed on the lock latch 308 for preventing pin 328 extending from the slide member 329 from penetrating opening 340.

Figure 11A:
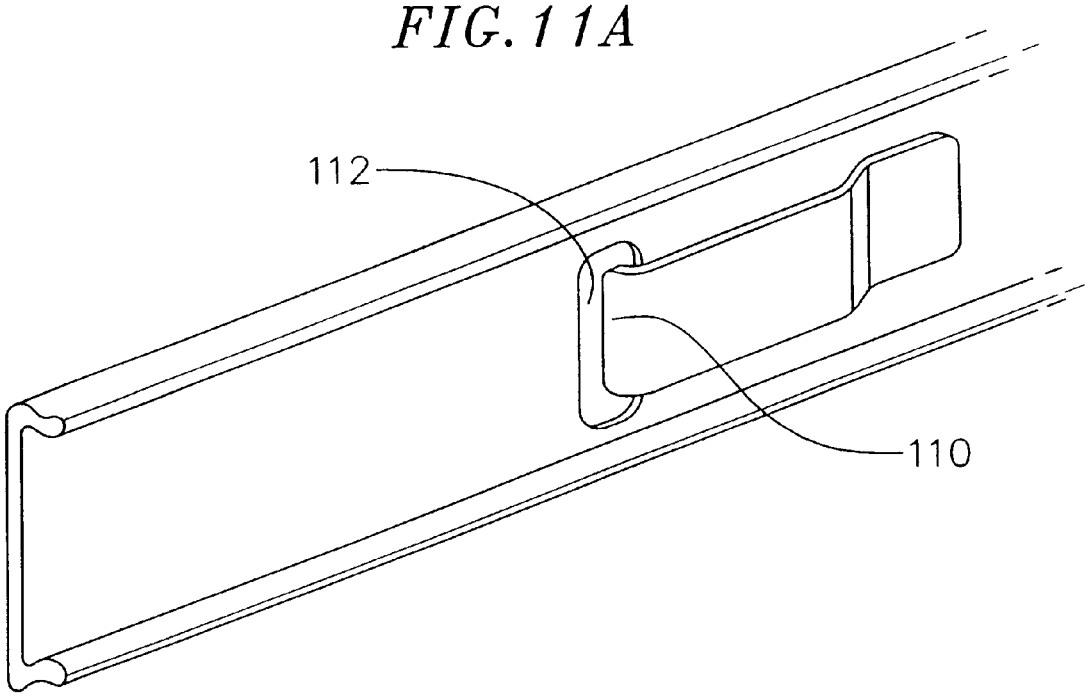
FIG. 11A is a perspective view of a lock latch having a bent tip.
Figure 11B:
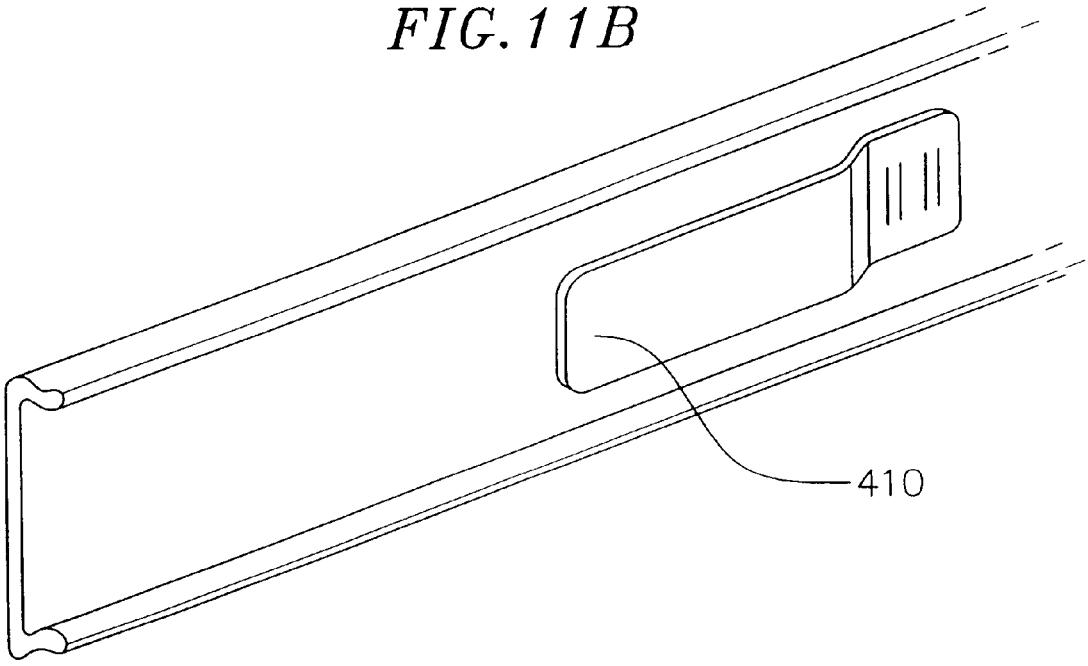
FIG. 11B is a perspective view of a lock latch having a flat tip.

Moreover, the lock latch may have a bent tip 110 as for example shown in FIG. 11A or a flat tip 410 as shown in FIG. 11B. If the lock latch is a flat tip, then the opening 112 on the web of the slide member incorporating the lock latch for accommodating the bent tip, is not necessary.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A slide comprising:

a first slide member;

a second slide member slidably coupled to the first slide member, wherein the second slide member can extend and retract relative to the first slide member;

a lock latch coupled to the second slide member for interlockingly coupling with the first slide member;

a jacket slidably coupled to the lock latch and slidably moveable between a first position and a second position along the lock latch, wherein when the second member is retracted relative to the first slide member during coupling of the second slide member to the first slide member, the jacket moves to the first position preventing the lock latch from interlockingly coupling with the first slide member, and wherein when the second slide member is extended relative to the first slide member, the jacket moves to a second position allowing for the interlocking coupling of the lock latch with the first slide member.

2. A slide as recited in claim 1 wherein the first slide member causes the jacket to slide between the first and second positions.

3. A slide as recited in claim 1 wherein the first slide member comprises at least one protrusion and wherein the lock latch comprises at least one cut out, wherein the lock latch interlockingly couples with the first slide member when said at least one protrusion penetrates said at least one cut out.

4. A slide as recited in claim 3 wherein when in the first position, the jacket prevents penetration of the cut out by said at least one protrusion.

5. A slide as recited in claim 3 wherein said at least one cut out is an opening formed through the lock latch.

6. A slide as recited in claim 3 wherein said at least one protrusion extends from the first slide member from a location proximate an end of the first slide member from which the second slide member extends relative to the first slide member.

7. A slide as recited in claim 6 wherein said at least one protrusion engages the jacket to move it to the first position when the second slide member is retracted relative to the first slide member during coupling of the second slide member to the first slide member, and wherein said at least one protrusion engages the jacket to move it to the second position when the second slide member is extended relative to the first slide member.

8. A slide as recited in claim 6 wherein the first slide member is an elongated member comprising an elongated web and a leg extending from either side of the web, wherein the web and legs of the first slide member define a channel, the first slide member further comprising an opening extending to said end of the first slide member from which the second slide member extends relative to the first slide member, wherein said at least one protrusion comprises a first tab extending from the web of the first slide member within the channel and a second tab extending from the web of the first slide member within the channel, and wherein the first and second tabs extend from opposite sides of said opening formed on the web of the first slide member.

9. A slide as recited in claim 8 wherein the lock latch comprises:

a first portion coupled to the first slide member;

a second portion extending at an angle relative to the first portion, wherein said at least one cut out comprises two cut outs, one cut out formed on one side of the second portion and another cutout formed on an opposite side of the second portion, wherein a neck is formed between the two cut outs, wherein the second portion further comprises a body and a head, wherein the body and head are interconnected by the neck, and wherein when the lock latch interconnectingly couples with the first slide member, each tab penetrates one of said cut outs.

10. A slide as recited in claim 9 wherein the body comprises two sections, a first section adjacent the neck and a second section extending from the first section, wherein the width of the first section is narrower than the width of the second section defining two shoulders on the body second section extending beyond the body first section and wherein two shoulders are formed on the head extending beyond the neck, wherein when in the first position the jacket abuts the shoulders formed on the head and wherein in the second position, the jacket abuts the shoulder formed on the body second section.

11. A slide as recited in claim 10 wherein the jacket comprises a first surface opposite a second surface sandwiching the lock latch.

12. A slide as recited in claim 10 wherein the jacket comprises:

a first panel;

a second panel opposite the first panel; and a third panel opposite the first panel and spaced apart from the second panel by a distance smaller than the width of the neck, wherein the first, second and third panels at least partially surround the lock latch.

13. A slide as recited in claim 12 wherein the jacket further comprises a first side surface transverse to the first and second panels and interconnecting the first and second panels, and a second side surface transverse to the first and third panels and interconnecting the first and third panels, wherein each of the first and second side surfaces comprises an end, each end engaging one of said body second section shoulders when the jacket is in the second position.

14. A slide as recited in claim 13 wherein the jacket further comprises a first end web portion transverse to the first and second panels and interconnecting the first and second panels, and a second web portion transverse to the first and third panels and interconnecting the first and third panels, wherein the first and second web portions each engage one of said head shoulders when the jacket is in the first position.

15. A slide as recited in claim 14 wherein the jacket is integrally formed as a unit.

16. A slide as recited in claim 12 wherein the lock latch further comprises a protrusion at the body first section, and wherein a cut out is formed on the first panel of the jacket extending to an end of the first panel for accommodating the protrusion when the jacket is in the second position.

17. A slide as recited in claim 1 wherein the lock latch comprises a protrusion and wherein the first slide member comprises a depression, wherein when the jacket is in the second position the protrusion is allowed to penetrate the depression for interlockingly coupling the lock latch with the first slide member.

18. A slide as recited in claim 1 wherein the lock latch comprises a protrusion and wherein the first slide member comprises an opening, wherein when the jacket is in the second position the protrusion is allowed to penetrate the opening for interlockingly coupling the lock latch with the first slide member.

19. A slide as recited in claim 8 wherein the second slide member is an elongated member comprising and elongated web an a leg extending from either side of the web, wherein the web and legs of the second slide member define a channel, wherein the channel of the first slide member faces the channel of the second slide member when the first and second slide member are slidably coupled, and wherein the lock latch is coupled to the web of the second slide member and extends within the channel of the second slide member, wherein the lock latch comprises a first end portion coupled to the web of the second slide member and a second end portion opposite the first end portion extending at an angle relative to the first end portion, and wherein an end of the second portion is bent toward the web of the second slide member.

20. A slide as recited in claim 19 wherein the web of the second slide member comprises a slot for receiving the bent end of the second portion of the latch when the second portion of the latch is pushed toward the web of the second slide member.

* * * * *